US011413730B2

(12) United States Patent
Doroslovac et al.

(10) Patent No.: US 11,413,730 B2
(45) Date of Patent: Aug. 16, 2022

(54) ANTI-SLIP HEX LOBULAR BIT

(71) Applicants: Robert Doroslovac, Massillon, OH (US); George Doroslovac, Tampa, FL (US)

(72) Inventors: Robert Doroslovac, Massillon, OH (US); George Doroslovac, Tampa, FL (US)

(73) Assignee: BGD Unlimted, LLC, Thonotosassa, FL (US)

( * ) Notice: Subject to any disclaimer, the term of this patent is extended or adjusted under 35 U.S.C. 154(b) by 348 days.

(21) Appl. No.: 16/819,660

(22) Filed: Mar. 16, 2020

(65) Prior Publication Data

US 2020/0298380 A1 Sep. 24, 2020

Related U.S. Application Data

(60) Provisional application No. 62/820,811, filed on Mar. 19, 2019.

(51) Int. Cl.
*B25B 15/00* (2006.01)

(52) U.S. Cl.
CPC ..... *B25B 15/005* (2013.01)

(58) Field of Classification Search
CPC ... B25B 15/004; B25B 15/005; B25B 23/105; B25B 23/108; B25B 13/065
See application file for complete search history.

(56) References Cited

U.S. PATENT DOCUMENTS

| | | | | |
|---|---|---|---|---|
| 6,223,634 | B1 | 5/2001 | Hughes et al. | |
| 9,821,442 | B2 | 11/2017 | Campbell | |
| 10,081,094 | B2 | 9/2018 | Doroslovac et al. | |
| 2015/0314429 | A1* | 11/2015 | Doroslovac | B25B 13/065 81/441 |
| 2018/0354102 | A1* | 12/2018 | Kukucka | B25B 13/04 |

* cited by examiner

*Primary Examiner* — David B. Thomas
(74) *Attorney, Agent, or Firm* — Harpman & Harpman

(57) ABSTRACT

A hex lobular headed bit and socket for efficient torque force application having a hex lobular shaped head and multiple engagement fins each with contoured fastener engagement surface channels defining pairs of omni-directional alternating first and second fastener engagement resistant points. The contoured first fastener engagement channels on the apex of the fins engages the fasteners displacing material imparting enhanced grip while the second engagement channel defines additional surface contact point to prevent slippage therebetween.

10 Claims, 3 Drawing Sheets

ANTI-SLIP HEX LOBULAR BIT

The application claims the benefit of U.S. Provisional Application No. 62/820,811, filed on Mar. 19, 2019.

BACKGROUND OF THE INVENTION

1. Technical Field

This invention relates to hex lobular headed bits for use with hex lobular head fasteners. Specifically, hex lobular heads an anti-slip multi-directional driver bit for driving and extraction of fasteners. Such tool bits known and used in the art includes a star like head having six points so as to be inserted into a fastener having a matching receptacle for rotation to tighten and loosen as required. Such reliance of star fastener bolt designs may be compromised to metal fatigue, rust and general abuse imparted by improper tool use.

2. Description of Prior Art

Prior art related bits and tool configurations can be seen in U.S. Pat. Nos. 6,223,634, 9,821,442 and 10,081,094.

In U.S. Pat. No. 6,223,634 a recessed head fastener and driver is disclosed wherein a recessed engageable driver may include a plurality of radially extending ribs configured to promote engagement of the ribs which outwardly requires of the drywalls.

U.S. Pat. No. 9,821,442 claims a driver bit having driving surfaces of limited length and shoulder portions positioned between the driving surfaces and a mid-body portion of the bit.

U.S. Pat. No. 10,081,094 discloses a multi-grip socket bit having a plurality of laterally bracing sidewalls including first and second lateral edges with bracing surface and an engagement cavity creating additional gripping point in positional offset from the first and second lateral edge distance.

SUMMARY OF THE INVENTION

The present invention provides a driver bit structure for engaging and maintaining efficient contact with a fasteners that may be compromised and thereby unable to transfer rotational force from the drive bit to the fastener while maintaining a proper engagement therewith. Contoured directional engagement surface channels within alternating pairs of contact fins on the tool bit maintain fastener engagement during rotational torque input in either direction.

DETAILED DESCRIPTION OF THE INVENTION

Figure 1:
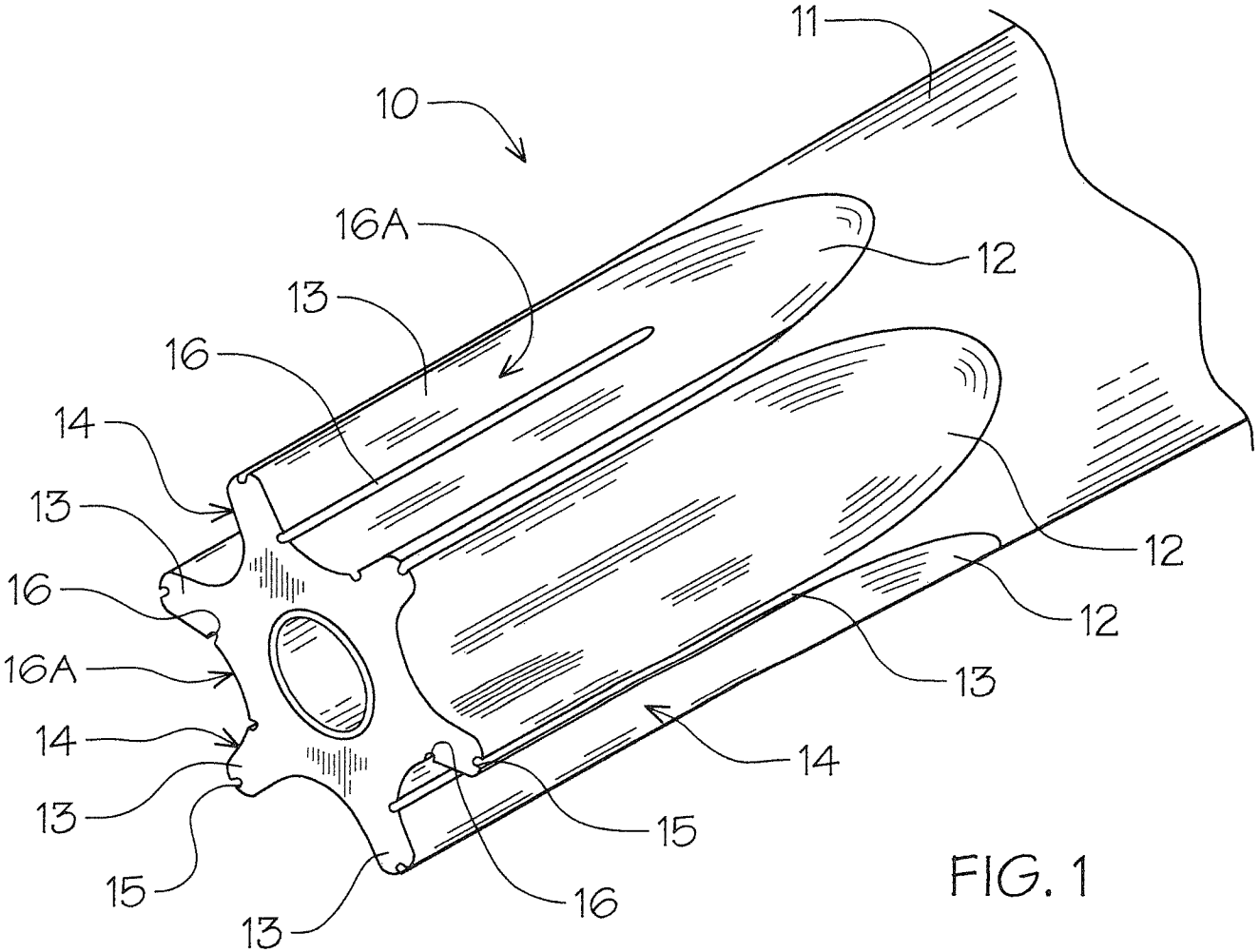
FIG. 1 is an enlarged perspective view of the hex lobular bit.
Figure 2:
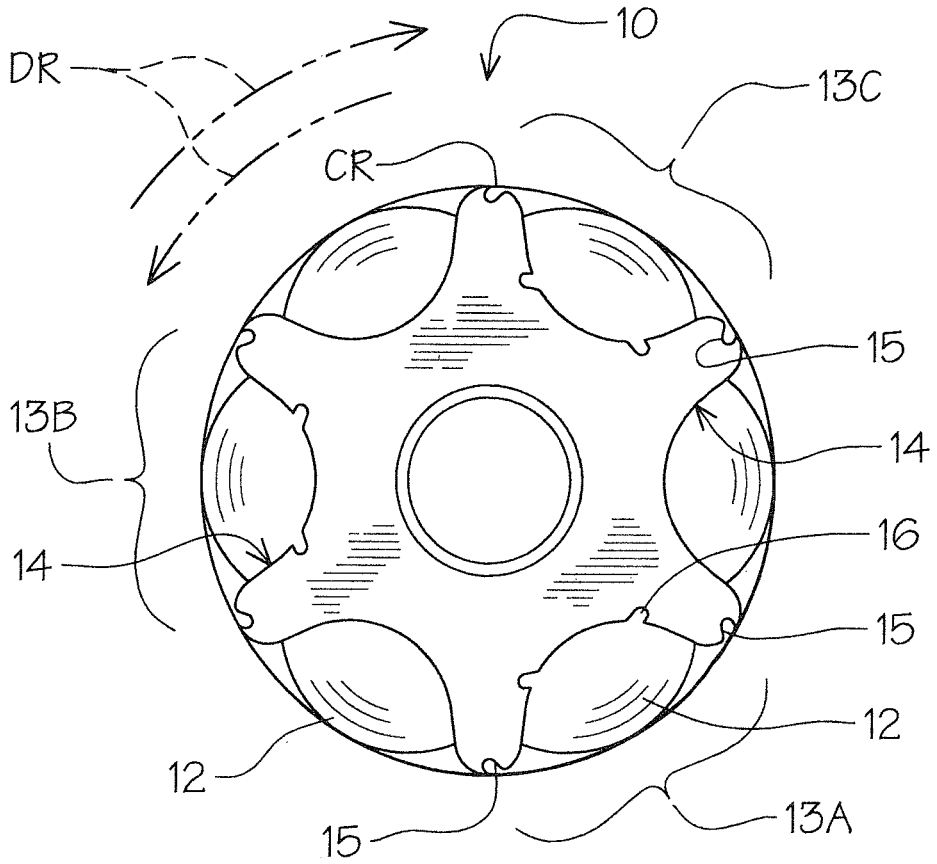
FIG. 2 is an enlarged end elevational view thereof.

Referring to FIGS. 1 and 2 of the drawings an anti-slip hex lobular bit 10 of the invention can be seen having a cylindrical screw bit body 11 with a plurality of annularly spaced longitudinally extending engagement cavities 12. Multiple fins 13 are formed between the respective adjacent engagement cavity pairs defining multiple fin engagement surfaces 14 complimentary to and engaging in corresponding socket of a fastener F of a hex configuration known within the art. The fin surfaces 14 are engaged in and against the registrations surfaces S of the hex fastener F seen graphically in FIG. 4 of the drawings, in this example. Each of the fin surfaces 14 have an elongated transversely contoured channel 15 within at its respective apex, best seen in FIG. 2 of the drawings.

Figure 3:
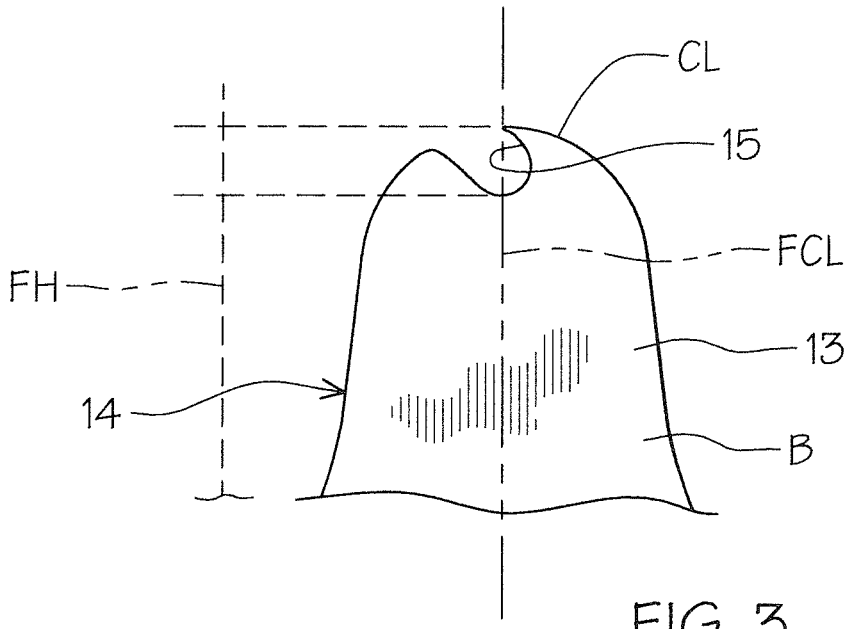
FIG. 3 is a graphic illustration of the engagement channel cut orientation.

Each contoured channel 15 is formed by a contoured cut right CR or contoured cut left CL of the fin's translateral axis center line, as seen in FIG. 3 of the drawings. The respective channel defined cuts CR and CL are characterized as extending approximately 3% off the center line of the bit 10 then curving away at 90 degrees at approximately 10% of the fin's height indicating at FH in angular determination transfer lines then dissipating into the fin's body B. The defined fin channels 15 extend approximately three quarters the respective fin's 13 length as determined by the corresponding cavities 12, hereinbefore described. As noted, the channels 15 are contoured left or right of the tool's fins centerline FCL and are positioned in contoured channel effacing fin pairs illustrated as 13A and 13B, 13C and 13D, 13E and 13F.

Each of the channel effacing fin pairs have a secondary contoured fastener engagement channel 16 within positioned in spaced relation to the apex positioned channel 15 in the respective fin's slope 16A, best seen in FIG. 2 of the drawings. The engagement channel 16 directional contour on each fin matches its apex channel 15.

The positioning of the respective fin's engagement channels 15 and 16 are critical to its operational efficiency and function. The apex fin engagement channel 15 engagement point is determined to be the most vulnerable points of the fastener subject to potential slip during tool rotational impingement force. Therefore, as the tool bit 10 slips, the primary apex contoured channels 15 engages the widest points of the so engaged fastener F. As rotated during operational impartment pressure is applied to the tool bit 10 and the apex fin channel cut edge will thereby dig into the fastener's engagement surface "rolling" fastener material, not shown, therefrom into the contoured channel 15 thereby imparting enhanced grip thereto. It will be seen that the secondary contoured fastener engagement channel 16 on the slope 16A of the respective fin 13 will act as an additional engagement slippage deterrent while the fastener still retains efficient integrity under rotational tool torque input.

Figure 4:
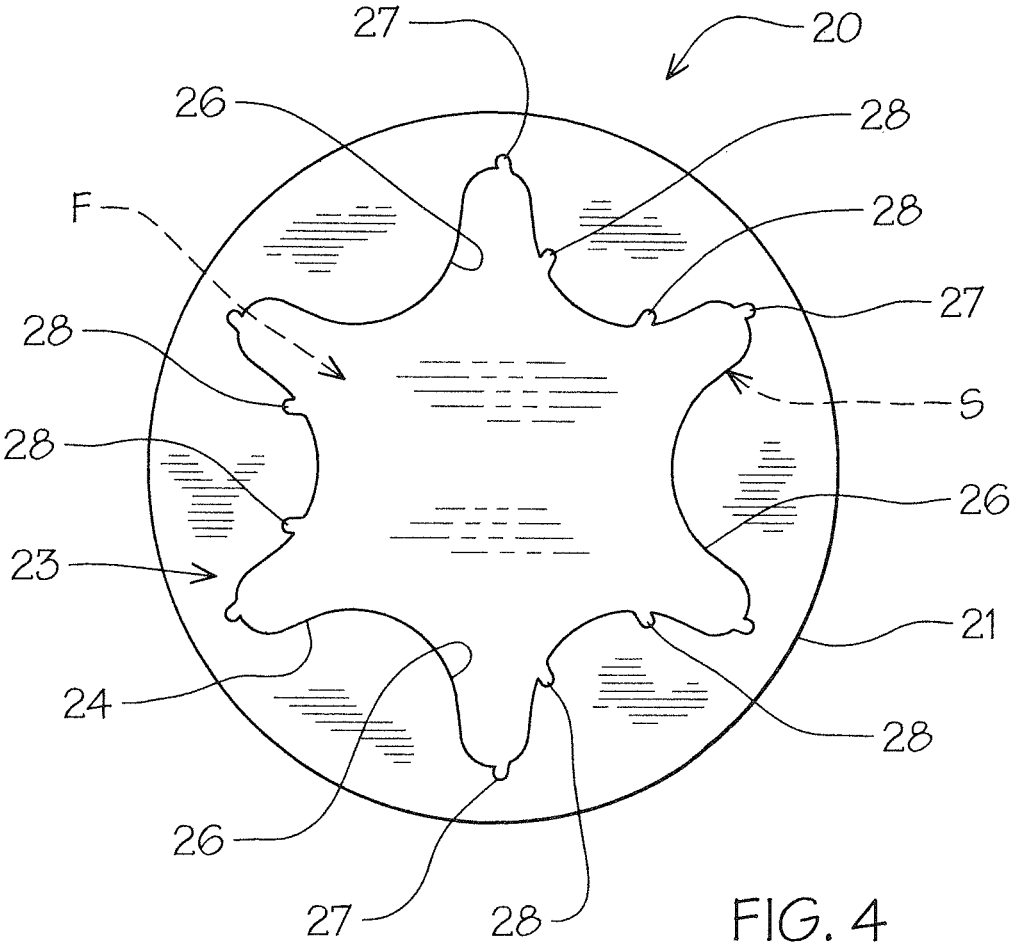
FIG. 4 is an enlarged graphic representation of an alternate female socket hex tool engagement of the invention.
Figure 5:
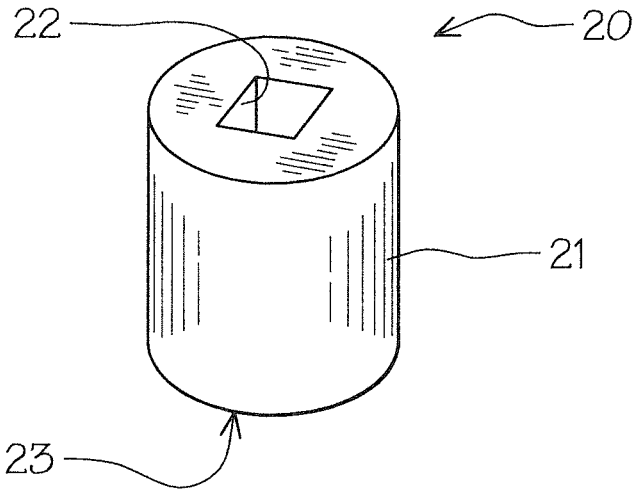
FIG. 5 is a perspective view of the alternate female socket configuration.

The present invention's rotational input directionally may be switched for fastener insertion and tightening or extraction as required given the contour of the apex channel 15 pairs directionality wherein alternate fin pairs provide corresponding alternate pair orientation of 13B and 13C, 13D and 13E, 13F and 13A. This can be seen in FIG. 2 of the drawings where directional rotation broken arrows DR are so illustrated. Referring now to FIGS. 4 and 5 of the drawings, an alternate female hex lobular socket 20 of the invention can be seen having an elongated cylinder body member 21 with a socket drive tool recess fitting 22 within an oppositely disposed hex lobular fastener engagement receiving socket 23.

The fastener engagement socket 23 has a continuous external circumference with an internal opening 24 to receive a hex fastener F head 25 illustrated in broken lines.

The fastener engagement socket 23 is therefore hexagonal with a plurality of contoured lobes 26 spaced radially about the longitudinal axis of the cylinder member 21. The lobes 26 define multiple fastener engagement surfaces there about with corresponding elongated principle engagement contoured channel cuts 27 there between the alternating lobe pairs defining fastener engagement surfaces there about. Secondary change cuts 28 are formed within alternating lobs 26.

It will be seen that the placement of the principle engagement contoured channels cuts 27 and 28 and their angular inclination will correspond to the hereinbefore described contoured center right CR or center left CL of the respective contoured channels 16 and 17 of the anti-slip hex lobular bit 10.

Thus the alternating positioning of the principle engagement contoured cuts 27 and its co-positioned secondary contoured cut 28 will form the same improved anti-slip engagement properties on fasteners F so engaged as described in the hex lobular bit 10.

It will be evident that the cylinder screw bit body 11 will provide for adaptive registration tool use having a male or female socket tool in both manual and power-driven alternate forms as will be understood by those skilled in the art.

It will be apparent to those skilled in the art that various changes and modifications may be made thereto without departing from the spirit of the invention, therefore we claim:

1. An omni-directional multi-grip socket bit for hex lobular fasteners comprising;

a screw bit body having a fastener engagement free end portion and a tool engagement end portion, a plurality of annularly spaced parallel elongated cavities extending individually inward from said screw body's first engagement free end radially positioned about a rotational axis thereof, elongated parallel engagement fins extending between said respective cavities, parallel contoured fastener engagement channel cuts in each of said engagement fins, said fastener engagement channel cuts define directional angular transverse surface orientation from radial center line axis of said bit body, one of said fastener engagement channel cuts in the apex of each of said engagement fins.

2. The multi-grip socket bit set forth in claim 1 wherein said elongated cavity ends taper transversely and axially in inward spaced relation to said fastener engagement free end portion.

3. The multi-grip socket bit set forth in claim 1 wherein said engagement channel cuts directional angular transverse orientation alternates from adjacent engagement fins defining alternating effacing and opposing directional engagement fin pairs.

4. The multi-grip socket bit set forth in claim 1 wherein one of said fastener engagement contoured channel cuts is formed on the slope of adjacent engagement fin pairs in spaced relation to said fins apex cutout channels.

5. The multi-grip socket bit set forth in claim 4 wherein said angular directional orientation of one of fastener engagement contour channel cuts are the same as said fins apex cutout channel directional orientation.

6. The multi-grip socket bit set forth in claim 1 wherein said channel cuts directional angular transverse surface orientation from radial center line axis is in the range of 2-4% pass its center line axis.

7. The multi-grip socket bit set forth in claim 1 wherein the channel cuts directional angular transverse surface orientation is between 9-12% of fins effective height from total center.

8. The multi-grip socket bit set forth in claim 1 wherein said channel cuts transverse determination is at 90% from fins apex.

9. A multi-grip socket bit for hex lobular fasteners comprising;

a socket body having a socket drive tool engagement fitting end, a hex lobular socket receiving fitting within said oppositely disposed end, a plurality of concentric lobes radially spaced within said hex lobular socket, elongated contoured engagement channel cuts in alternating spaced lobes, said contoured engagement channel cuts defining directional angular transverse surface orientation, one of said fastener engagement channel cuts positioned between each of said lobes in angular transverse surface orientation to said adjacent contoured engagement channel cuts in said alternating spaced lobes.

10. The multi-grip socket bit for hex lobular fasteners set forth in claim 9 wherein said engagement channel cuts directional angular transverse orientation alternates from adjacent engagement lobes defining alternate effacing and opposing directional engagement lobe pairs.

* * * * *